United States Patent [19]

Doveri

[11] 4,191,156

[45] Mar. 4, 1980

[54] TWO-STROKE, WATER-COOLED INTERNAL COMBUSTION ENGINE HAVING THE CYLINDER LINERS REMOVABLE FROM THE CYLINDER BLOCK

[75] Inventor: Carlo Doveri, Pontedera, Italy

[73] Assignee: Piaggio & C. S.p.A., Genoa, Italy

[21] Appl. No.: 862,761

[22] Filed: Dec. 20, 1977

[30] Foreign Application Priority Data

Dec. 30, 1976 [IT] Italy ..... 31023 A/76

[51] Int. Cl.[2] ..... F01N 7/10

[52] U.S. Cl. ..... 123/193 C; 123/41.72; 123/41.84; 123/65 EM; 123/65 PE; 123/65 P; 123/73 A

[58] Field of Search ..... 123/41.72, 41.84, 41.78, 123/65 EM, 65 PE, 73 A, 65 P, 73 PP, 65 PD, 193 C, 193 H

[56] References Cited

U.S. PATENT DOCUMENTS

| | | | |
|---|---|---|---|
| 1,623,639 | 4/1927 | Setz | 123/41.78 |
| 1,674,832 | 6/1928 | Lugt | 123/41.78 |
| 1,684,407 | 9/1928 | Nibbs | 123/41.84 |
| 2,395,110 | 2/1946 | Forrest | 123/193 C |
| 2,703,077 | 3/1955 | Antonsen | 123/193 C |
| 2,737,171 | 3/1956 | Torre | 123/193 C |
| 2,740,390 | 4/1956 | Irgens | 123/73 A |
| 4,016,850 | 4/1977 | Bloemers | 123/193 C |

FOREIGN PATENT DOCUMENTS

| | | | |
|---|---|---|---|
| 572654 | 10/1945 | United Kingdom | 123/193 C |

*Primary Examiner*—Charles J. Myhre
*Assistant Examiner*—Jeffrey L. Yates
*Attorney, Agent, or Firm*—Cushman, Darby & Cushman

[57] ABSTRACT

In a two-stroke, water-cooled internal combustion engine the improvement is disclosed which permits to have a removable cylinder liner type of engine in spite of the intricate constructional arrangement of such engines having transfer ports and exhaust ports. The improvement consists in that the transfer and exhaust ports are formed through the liners and flanged fittings are provided between the liner transfer ports and the transfer ducts so as to ensure complete tightness. Differential-firmness gaskets are provided where appropriate and the engine is then assembled by stay bolts as usual. The construction suggested by the invention not only solves the tightness problem satisfactorily, but minimizes the stresses on the liners, especially the bending stresses.

17 Claims, 3 Drawing Figures

TWO-STROKE, WATER-COOLED INTERNAL COMBUSTION ENGINE HAVING THE CYLINDER LINERS REMOVABLE FROM THE CYLINDER BLOCK

This invention relates to a two-stroke, water-cooled internal combustion engine in which the cylinder liners are appropriately made removable from the cylinder block so as to achieve, in comparison with the engines as produced at present, the advantages of a constructional simplicity and a quick replaceability.

Generally speaking, the construction of engine cylinders having removable liners is already known and is used in a few four-stroke engines, in which the advantages of a careful and simple construction of the liners disjointly from that of the engine block and their convenient and cheap replaceability in the case of a fault or of wear can be achieved without any special problems, inasmuch as the design of such engines is very simple.

As a matter of fact, in four-stroke engines, the liners can be considered as cylindrical bodies of rotation, so that no problem is encountered when forming appropriate seatings in the engine block and the liners can easily be inserted into, or removed from such seatings.

In the case of two-stroke engines having a distribution with transfer and exhaust ports formed through the cylinders, problems are encountered, conversely, which are connected with construction, installation and tight seal of the union between the ports aforesaid and the engine block through which a coolant is caused to flow. Such problems are aggravated by the fact of an uneven distribution of the temperatures and a consequential stress and strain system which is more intricate than that encountered in four-stroke engines.

Inasmuch as the ports are formed through the liner wall, a construction method such as that adopted for four-stroke engines is inadequate.

An object of the present invention is to permit that the constructional methods adopted for the "wet liners" in the field of four-stroke engines be transferred into the field of the two-stroke engines by overcoming the technical problems which are originated by such a desired transfer.

The Applicants have found that it is possible to circumvent the problem of the seal of the liners in correspondence with the transfer ducts by incorporating such ducts in the removable liners and shaping the cavity in the engine block in such a way as to enable the liners to be inserted into and removed from the respective resting and centering seatings, that is to say, without any interference between the seatings and the projections of the liners which are formed just by the transfer ducts, the top centering operation being performed only in the cylindrical portions which are left free by the ducts, whereas the problem of water and gas tightness between the lower edge of the liners and the bottom wall of the engine block and between the cylinder heads and the top surfaces of the liners and the engine block, the latter being coplanar with the head surface, can be solved by planar front gaskets which are sandwiched, with the aid of appropriate stay bolts between the head, on the one side, and the liners and the engine block on the other side.

The problem of the tightness of the connection between the exhaust ports formed through the liners and the exhaust ducts formed in the engine block is more difficult to be solved due to the compatibility with the other seals in connection with the machining tolerances, the necessity of an easy mounting and replacement of the spares, the high temperature of the surrounding areas and the endurance of the connection with the lapse of time.

It has been found that such a problem can be solved with an appropriate configuration and structure of the sealing surfaces and of the gasket inserted therebetween. More particularly, the exhaust port of a liner is connected with the opening through the engine block which confronts such port, by the agency of a sleeve member which rests with its base surface on the liner and rests with a shoulder against the periphery of the engine block opening, differentially yielding gaskets being inserted therebetween.

In order that the invention may be better understood, an exemplary embodiment thereof is described in the following disclosure, aided by the accompanying drawings, wherein.

Figure 1:
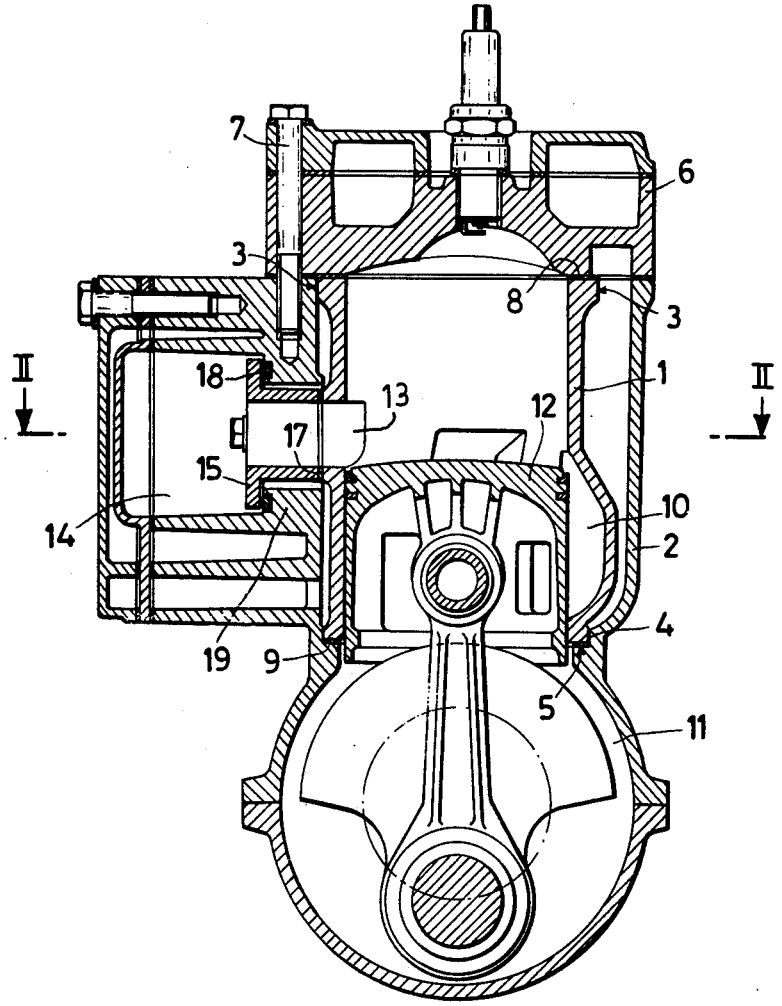
FIG. 1 is a cross-sectional view of the engine in correspondence with the axis of a cylinder, taken along the line I—I of FIG. 2.
Figure 2:
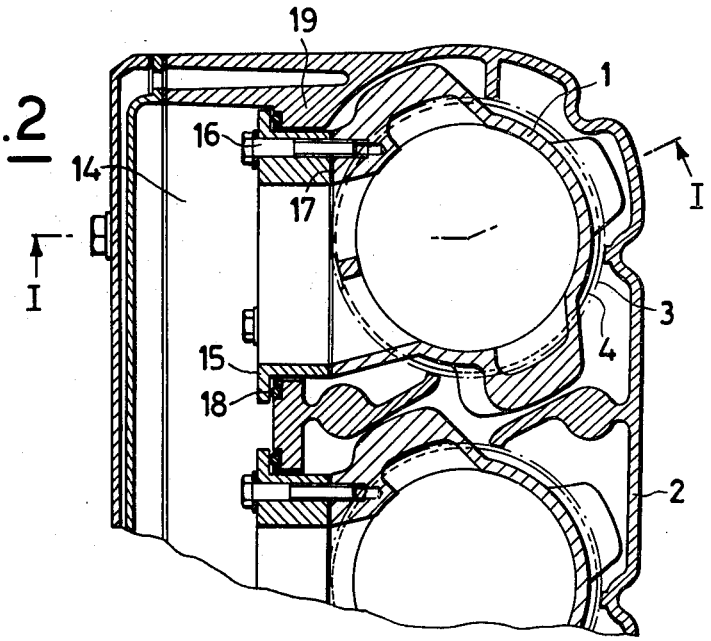
FIG. 2 is a cross-sectional view taken along the line II—II of FIG. 1.
Figure 3:
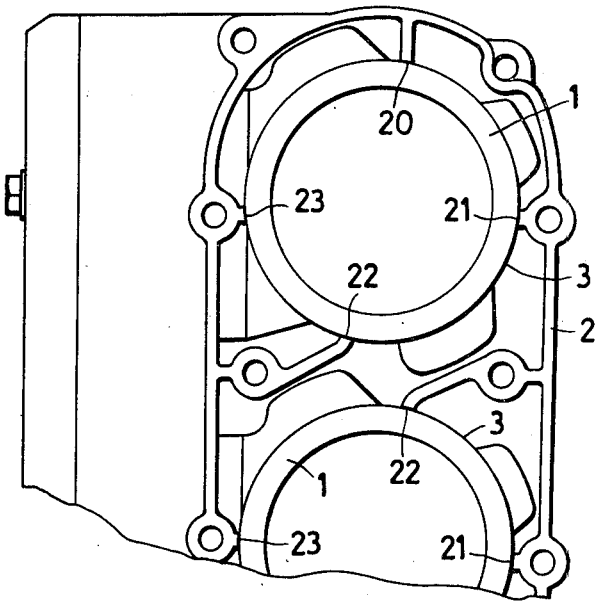
FIG. 3 is a plan view of the engine of FIG. 1, from which the head has been removed.

The liners, 1, are inserted into the engine block, 2, wherein they are centered in correspondence with the cylindrical surfaces 3 and 4 and are axially clamped between the surface 5 of the baseplate and the heads 6 of the cylinders by the agency of stay bolts 7 through the gaskets 8 and 9 which provide a tight gas seal in the interior of the liners and a water tight seal for the coolant which flows through the engine block and the head and surrounds almost completely the cylinder liners.

It will be seen that the cylindrical surface 3 is radially held by resting areas in the form of ribs, of which 20, 21, 22 and 23 are examples, which are extended in correspondence with the generating lines of the liners wherethrough no ports are opened and thus where the axial sections of the liners can take a non-convex outer configuration. But such provision, the liners can be inserted into the engine block, and removed therefrom, without any difficulty. In the spaces which are formed between adjoining ribs there are thus received without any difficulty the convex projections which define in the liners the passageway into which the transfer ports open.

Actually, through the liners 1, the transfer ducts 10 are formed, which establish a communication between the interior of the liners and the interior of the crankcase 11 through the pistons 12 of the engine, and the exhaust ports, 13, are likewise formed through such liners.

The tight seal between the liners 1 and the exhaust duct 14 in correspondence with the ports 13 is obtained by the agency of the fittings 15 which are clamped against the liners by the bolts 16 with sealing gaskets 17 inserted between the liners and the fittings 15, and sealing gaskets 18 inserted between said fittings and the shoulders 19 of the engine block 2.

The liners 1 can thus be slipped out of the top section of the engine block after having removed the cylinder heads and the fittings 15.

Generally speaking, the number of the engine cylinders is not critical since the principles of this invention can equally well be applied to single-cylinder engines and plural-cylinder ones.

The problem of the two-fold seal between the fittings 15 and the corresponding matching surfaces of the liners and the engine block is solved by making the gasket 18 much more yieldable than the gasket 17, so that the fittings 15 become integral with the liners by the instrumentality of the pull exerted by the bolts 16, but only after that the gaskets 18 have been deformed and that, consequently, the relevant tight seal has been obtained without any appreciable bending stresses being impressed onto the liners: these are resting on the housings 3 and 4 and are loaded by the pressure of the shoulders 19 of the engine block.

Similar considerations can be made also regarding the bending of the liners in the plane perpendicular to the liner axis. From this point of view, the elastic deformations, which inevitably arise in the matching operation, can further be minimized by an appropriate arrangement of the bolts 16 relative to the resting surfaces of the fittings on the liners and the engine block.

More particularly, the gasket 17 can be, like the one placed between the head and a liner, of asbestos, possibly with an edge lined with a sheet metal and the gasket 18 can be a rubber "O-ring".

In addition to the advantages of constructional simplicity and replaceability of the liners according to this invention, special mention is deserved by the fact that the cooling water can completely surround both the cylinder liners and the transfer ducts and also the fittings of the exhaust ducts.

It is understood that the FIGURES of the drawing show in a diagrammatical fashion only one of the possible embodiments of the invention, modifications and changes being possible withtout departing from the principles and the scope of the appended claims.

I claim:

1. In a two-stroke internal combustion engine of the compression crankcase type: an engine block having at least one cavity which defines a seating with a substantially annular bottom wall and with a discrete number of spaced apart lateral resting surfaces formed in correspondence with the top surface of the engine block; an engine head releasably attached to the top surface of the engine block, the annular bottom wall receiving in sealtight manner the lower edge of an inserted cylinder liner, the exterior surface of said liner forming with the engine block a cooling jacket and the top edge of the liner being laterally received on said resting surfaces and confined at its top by a surface which is substantially coplanar with the top surface of the engine block so as to receive in a sealtight manner the engine head, the liner having transfer ducts formed therethrough in portions of the liner which project laterally outward of the remainder of the liner, said resting surfaces of the engine block receiving the top edge of the liner in correspondence with sectors thereof which are spaced from the areas from which the transfer ducts project, so that the liner can be slipped out of the engine block, the liner having at least one exhuast port formed therethrough and the block having an exhaust duct disposed at the location of the exhaust port, means for providing a tight seal between said exhaust port and said exhaust duct, said means including a fitting in the form of a sleeve and means for clamping the sleeve to the liner and to corresponding resting surfaces on the block.

2. An engine as in claim 1 wherein the resting surface for the liner relative to the engine block is formed, in the bottom section, by a cylindrical seat and in the top section by centering ribs for the cylindrical edge of the liner in sectors which are devoid of projections of the transfer ducts, whereas the tight seal at the bottom and top edges of the liner is provided by planar front gaskets sandwiched between the liner and the engine block, and between the liner and the cylinder heads, respectively, by stay bolts.

3. An engine as in claim 1 wherein the fitting is flanged at its outer end and is introduced into a corresponding bore through the engine block until the inner end of the fitting contacts the liner and is held in such contact in a tight-seal manner by bolts, the flange of the sleeve resting in a sealtight manner against the outer surface of the engine block.

4. An engine as in claim 3 wherein tight seals between the inner end of the fitting and the liner and between the flange and the engine block are provided by special gaskets which have different degrees of firmness.

5. An engine as in claim 4 wherein the first sealing gasket between the fitting and the liner is firmer than the second sealing gasket between the flange and the cylinder block.

6. A sleeve as in claim 5 wherein said first gasket is a flat type of gasket and wherein said second gasket is of the circular cross-section type.

7. An engine as in claim 3 wherein the distance between the bolts holding the fitting to the liner is such, as a function of the liner diameter and the distance between the resting surfaces on the block for the sleeve flanges, such that the unavoidable deformations encountered during assembly are minimized.

8. An engine as in claim 3 wherein the fitting is are radially spaced apart from the engine block by the agency of a cooling jacket.

9. A two-stroke, water-cooled internal combustion engine including an engine block provided with at least one cavity in which a cylinder liner housing a reciprocating piston is removably inserted, said liner being provided with an exhaust port and with transfer ducts formed by lateral outwardly projecting portions of the liner, said exhaust port communicating in sealtight manner with an exhaust duct in the engine block through a tubular fitting, the fitting being clamped by clamping means to the liner and to the block so as to provide a tight-seal between the exhaust port and the exhaust duct.

10. An engine according to claim 9, wherein said fitting has one end in contact with the outer surface of the liner and another flanged end in contact with the outer surface of said wall of the engine block.

11. An engine according to claim 9, wherein a first sealing gasket is inserted between said fitting and said liner and a second sealing gasket is inserted between said fitting and said wall of the engine block.

12. An engine according to claim 11, wherein said first gasket is of flat type.

13. An engine according to claim 11, wherein said first gasket is stiffer than said second gasket.

14. An engine according to claim 13, wherein said first gasket is formed by asbestos having metal-reinforced edges, and said second gasket is formed by a rubber ring.

15. An engine according to claim 9, wherein said fitting is fixed to the liner by two bolts.

16. An engine according to claim 9, wherein said fitting is radially spaced from the engine block so as to define a cooling jacket.

17. An engine according to claim 9, wherein the upper end of the liner is centered with respect to said cavity of the engine block only at lateral portions of the liner which are circumferentially spaced from said outwardly projecting portions of the same liner, flat front gaskets being interposed between end portions of the liner and corresponding shoulders of the engine block.

* * * * *